United States Patent [19]

Glover

[11] Patent Number: 4,928,587

[45] Date of Patent: May 29, 1990

[54] PROGRAMMABLE PAD PRINTER

[75] Inventor: Douglas L. Glover, Scottsdale, Ariz.

[73] Assignee: Motorola Inc., Schaumburg, Ill.

[21] Appl. No.: 373,704

[22] Filed: Jul. 3, 1989

Related U.S. Application Data

[63] Continuation of Ser. No. 160,974, Feb. 26, 1988, abandoned.

[51] Int. Cl.[5] ..... B41F 17/00

[52] U.S. Cl. ..... 101/42; 101/163

[58] Field of Search ..... 101/41, 44, 163, 366, 101/42, 43

[56] References Cited

U.S. PATENT DOCUMENTS

| | | | |
|---|---|---|---|
| 2,333,172 | 11/1943 | Grupe | 101/170 X |
| 3,321,768 | 5/1967 | Byrd | 101/112 X |
| 3,737,251 | 6/1973 | Berman et al. | 101/366 X |
| 3,739,717 | 6/1973 | Brown et al. | 101/37 |
| 3,910,183 | 10/1975 | Noren et al. | 101/41 |
| 4,431,321 | 2/1984 | Trimble | 400/130 |
| 4,557,195 | 12/1985 | Philipp | 101/163 |
| 4,738,198 | 4/1988 | Sillner | 101/163 X |

FOREIGN PATENT DOCUMENTS

| | | | |
|---|---|---|---|
| 140384 | 5/1985 | European Pat. Off. | 101/163 |
| 178112 | 4/1986 | European Pat. Off. | 101/163 |
| 3522500 | 1/1987 | Fed. Rep. of Germany | 101/163 |
| 84259 | 4/1986 | Japan | 101/163 |
| 225347 | 10/1987 | Japan | 101/163 |

OTHER PUBLICATIONS

Pitts, "Rotary Indexed Printing Plate", IBM Tech. Disc. Bul., vol. 20, No. 9, pp. 3620–3621, 02/1978.

*TSF Peristaltic Pumps,* Technical Services & Fabrication, Inc. brochure, date stamped 07/22/1976; 3 pages.

Brochure–Standard Machines Tampoprint America, Inc., no date.

Brochure–Markem 530 Series, printed 10/86.

*Primary Examiner*—Clifford D. Crowder

*Attorney, Agent, or Firm*—Joe E. Barbee; Stuart T. Langley

[57] ABSTRACT

A programmable pad printer which responds to an input signal by selecting one of a plurality of marks for transfer to a semiconductor. The input signal is provided to the printer from an external source, such as a semiconductor tester. The appropriate mark is then presented to an opening in a housing by rotating a disc containing the plurality of marks. A print head picks up the mark from the disc and transfers it to the semiconductor.

4 Claims, 3 Drawing Sheets

PROGRAMMABLE PAD PRINTER

This application is a continuation of prior application Ser. No. 07/160/974, filed Feb. 26, 1988, now abandoned.

BACKGROUND OF THE INVENTION

The invention relates, in general, to pad printers and, more particularly, to programmable pad printers for marking semiconductors.

A number of apparatus are available for marking semiconductors. These prior art devices have a plate on which the marking is engraved. This plate is then coated with ink and wiped. The wiping action cleans the surface of the plate leaving ink in the etched marking area. The ink in the etched marking area is then picked up by a pad and transferred to the device.

These printers have the disadvantage of being limited to using one type of mark. To change the mark it is necessary to stop the marking process and exchange plates.

In addition, the ink is in a pool which, along with the plates, is generally in a semi-open environment which allows the ink to become dried out. This requires frequent maintenance to clean the printer.

Further, these prior devices are relatively large and rather slow.

Accordingly, it is an object of the present invention to provide a programmable pad printer that overcomes the above deficiencies.

A further object of the present invention is to provide a programmable pad printer that is compatible with existing equipment.

Another object of the present invention is to provide a programmable pad printer that can be integrated with testing equipment.

Still another object of the present invention is to provide a programmable pad printer that can be integrated with sorting equipment.

Yet another object of the present invention is to provide a programmable pad printer that is more economical.

Another objective of the present invention is to provide a programmable pad printer that requires less maintenance.

SUMMARY OF THE INVENTION

A particular embodiment of the present invention consists of a printing pad functioning in cooperation with a disc engraved with a plurality of marks. In operation, a signal is sent to the printer which designates the mark to be placed on the upcoming device. The disk is rotated to present that mark to the printing pad. The printing pad then picks up the mark from the disc and deposits it on the device.

DETAILED DESCRIPTION OF THE DRAWINGS

Figure 1:
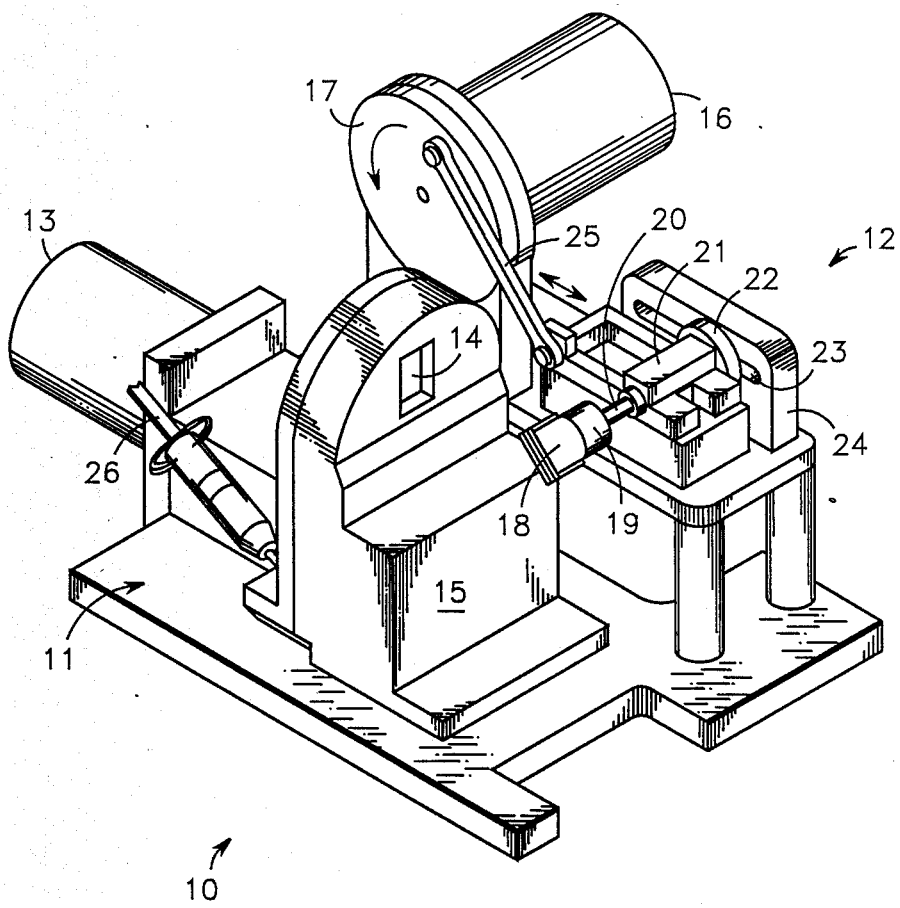
FIG. 1 is a view in perspective of a programmable pad printer embodying the present invention.

Referring first to FIG. 1, a programmable pad printer, generally designated 10, is illustrated. Printer 10 basically contains a selecting means 11 and a printing means 12.

Selecting means 11 responds to a signal from an outside device, not shown, such as a tester. This signal regulates motor 13. Motor 13 acts on a disc to present the appropriate mark to a window 14 of a housing 15. At this point the mark is inked by inking means 26 and ready to be transferred to the device being marked.

Printing means 12 acts in concert with selecting means 11 to transfer the mark to the device. Printing means 12 consists of a motor 16 which rotates a disc 17. Printing means 12 further comprises a printing pad 18 having a printing surface 19. Printing pad 18 is coupled to a shaft 20 which passes through a slide means 21. On the end of shaft 20 opposite printing pad 18 is a cam 22. An off center pin, not shown, extends out the back of cam 22 and into an opening 23 of a cam guide block 24. A tie bar 25 extends from disc 17 to slide 21.

As disc 17 is rotated in a clockwise direction from its present position, slide 21 is drawn toward motor 16. As slide 21 is drawn toward motor 16, cam 22 reacts with cam guide block 24 to cause surface 19 of printing pad 18 to rotate counter clockwise. Upon further rotation of disc 17, surface 19 is inserted into opening 14 of housing 15 picking up the mark. As disc 17 continues to rotate, pad 18 is removed from opening 14; rotated clockwise 180°; and surface 19 is pressed on a device, transferring the mark to the device.

It should be noted here that while the embodiment illustrated in FIG. 1 rotates pad 18 about 180°, this rotation could be any amount depending on the application. In addition, the design of printer 10 allows vertical mounting of the device. This vertical mounting is permitted as a result of housing 15 and the method utilized to provide ink to the disc, illustrated in FIG. 2, below.

Figure 2:
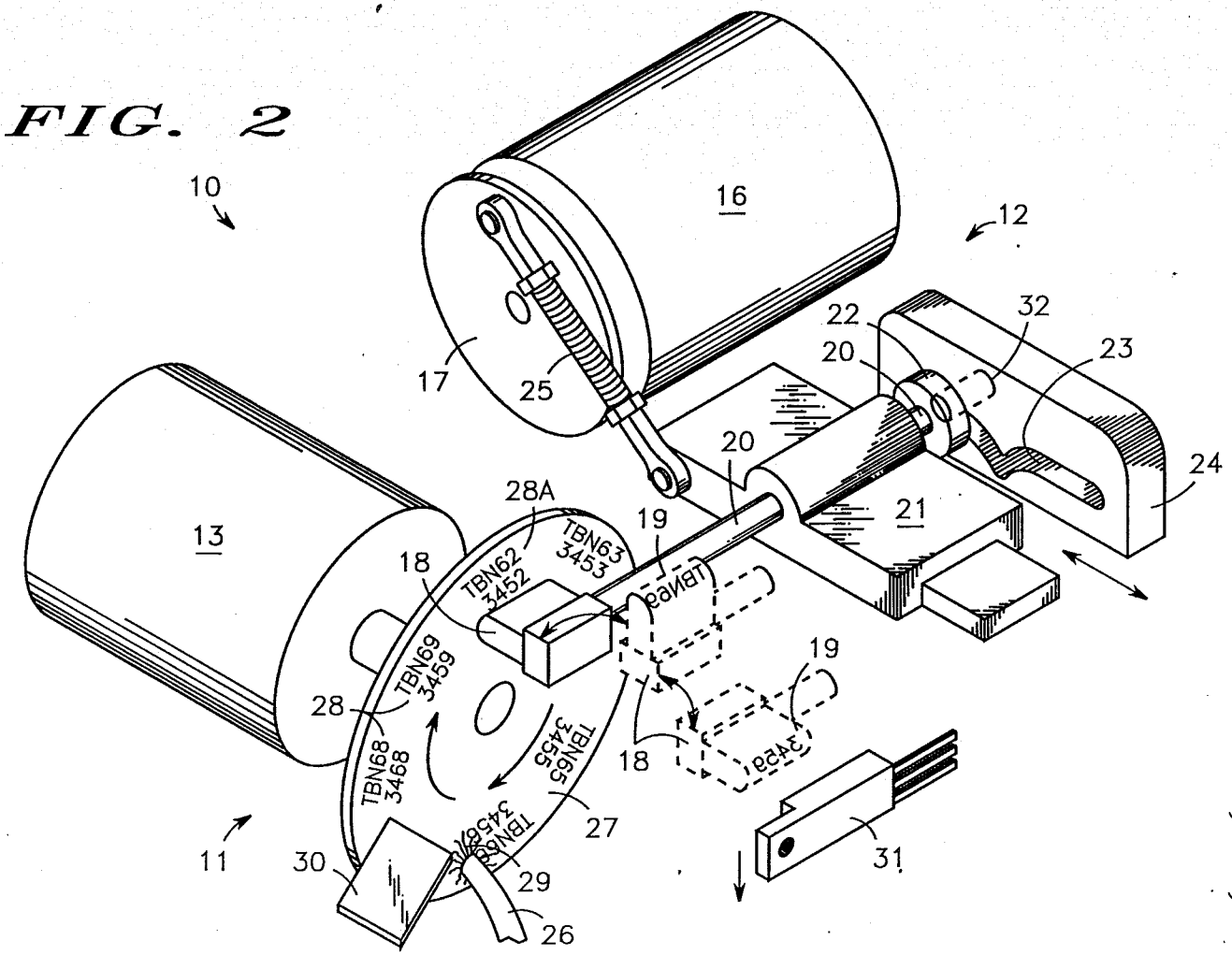
FIG. 2 is the programmable pad printer of FIG. 1 with portions being broken away.

The operation of printer 10 is illustrated in more detail in FIG. 2. As shown, inside housing 15 is a disc 27. Disc 27 is an example of a device having a surface engraved with a plurality of marks 28. In operation, disc 27 is rotated in a counter clockwise direction. At a preselected number of rotations, ink injecting means 26 sprays ink 29 on disc 27. This can be accomplished by a peristaltic pump with a stepper motor, not shown. This acts to supply only the ink needed preventing evaporation of the stored ink.

Disc 27 then rotates past a wiper 30 which wipes the excess ink off the surface of disc 27 and leaves it in marks 28. The excess ink forms a bead between disc 27 and wiper 30. As disc 27 continues to rotate, the excess ink will be pressed into any empty marks as the marks pass by wiper 30. This entire operation is performed within housing 15 which has a pool of solvent in its base. The pool of solvent does not contact disc 27 but creates an atmosphere within housing 15 which prevents the ink from drying out. This allows the printer to operate for longer durations without requiring maintenance. In addition, disc 27 can be rotated at higher speeds in the solvent environment without drying the ink.

Responding to a signal from an outside source, motor 13 rotates disc 27. Disc 27 is rotated to present a particular mark **28*a* to a location where it can be picked up by printing pad 18**. The mark is then transferred to a device 31. The transferring of the mark is accomplished by motor 16 rotating disc 17. This in turn draws slide 21 toward motor 16 by use of tie bar 25. As slide 21 moves toward motor 16, a pin 32 of cam 22 follows along opening 23 of cam guide block 24. This causes pad 18 to rotate such that surface 19 is facing disc 27. Further movement of slide 21 presses surface 19 against disc 27 over mark 28*a*. This causes the ink in mark 28*a*. to be transferred to surface 19. It should be understood that the operation of disc 27 and pad 18 are coordinated but operate independently. This allows disc 27 to be rotated simultaneously with the movement of pad 18.

Following the pick-up of mark 28*a*., disc 17 continues to rotate causing slide means 21 to move away from motor 16. This causes pad 18 to be removed from disc 27. As slide means 21 moves further, pin 32 of cam 22 follows opening 23 of cam guide block 24 causing pad 18 to be rotated clockwise 180°. Slide means 21 then pushes surface 19 against device 31. This transfers the mark from surface 19 to device 31.

Figure 4A:
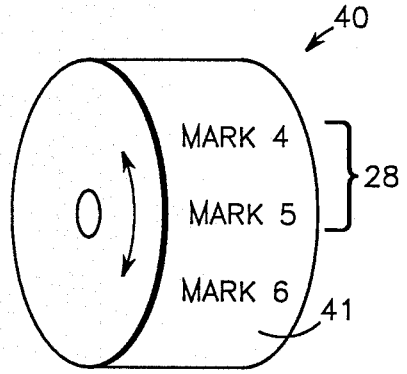
FIGS. 4A–4C are optional devices which may be utilized in place of the disc of FIG. 2.
Figure 4B:
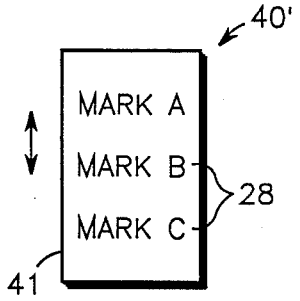
Figure 4C:
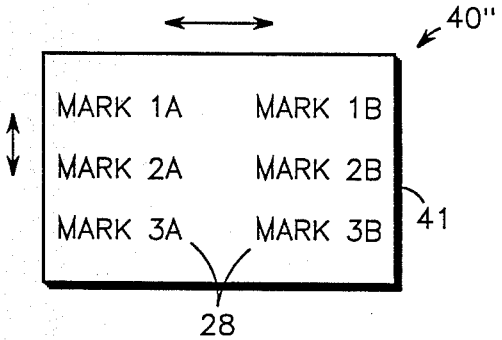

Various types of devices may be used in place of disc 27. Some of these are illustrated in FIGS. 4A–4C. In FIG. 4*a*, a drum 40 is illustrated having marks 28 on a surface 40. Drum 40 can be rotated either clockwise or counter clockwise to reach the desired mark 28.

Another example of a device which can be used in place of disc 27 is illustrated in FIG. 4B. A narrow flat plate 40′ is shown which can be mounted to index up and down. Marks 28 are inscribed on a surface 41 of plate 40′.

A third type of replacement device for disc 27 is plate 40″, FIG. 4C. This plate has surface 40 inscribed with marks 28 and can be indexed up and down and/or right and left.

Figure 3:
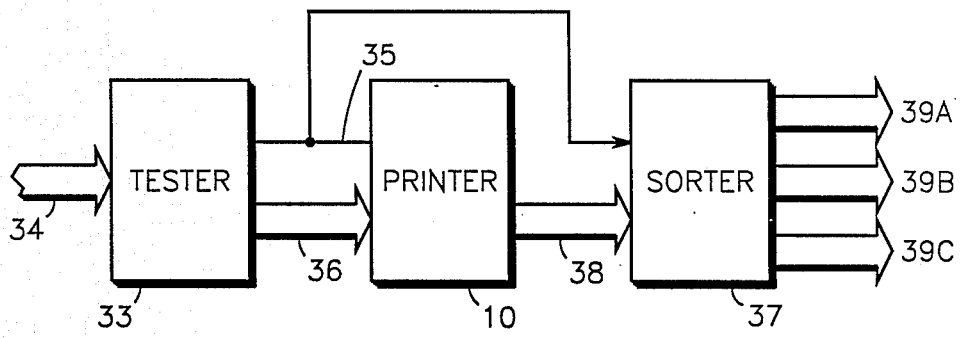
FIG. 3 is a process flow diagram of an integrated test and mark system embodying the present invention.

In a production environment, programmable pad printer 10 could be installed in an automated line to mark devices as they are tested. Thru its ability to operate vertically, horizontally, or any angle in between, printer 10 may be adopted to various devices. An example of one production flow is shown in FIG. 3. In this process, devices are input into a tester 33 as indicated by arrow 34. The device are then tested and the test results are transmitted to printer 10 along line 35. The tested parts are then transferred to printer 10 as illustrated by arrow 36. The devices are marked by printer 10 according to the testing information received. After marking, the devices are transferred to sorter 37 as represented by arrow 38. Sorter 37 also uses the test results from tester 33 transmitted along line 35 to sort the devices as they are received. The sorted devices are then output as represented by arrows 39*a*–39*c*.

One example of a integrated tester/sorter in which printer 10 may be incorporated is shown in U.S. Pat. No. 4,709,801 entitled "Input Buffer and Article Injector Mechanism for an Automated Article Handler" issued to Swapp et al. and assigned to Motorola Inc.

Thus, it will be apparent to one skilled in the art that there has been provided in accordance with the invention, a device that fully satisfies the objects, aims, and advantages set forth above.

While the invention has been described in conjunction with specific embodiments thereof, it will be evident that many alterations, modifications, and variations will be apparent to those skilled in the art in light of the foregoing description. Accordingly, it is intended to embrace all such alterations, modifications, and variations in the appended claims.

I claim:

1. A programmable pad printer comprising:
programmable selecting means for selecting a designated mark from a plurality of marks;
ink means for supplying ink to said programmable selecting means;
a device to be marked;
printing means for transferring said designated mark from said programmable selecting means to said device;
wherein said programmable selecting means comprises:
a mark containing device having a surface containing a plurality of marks thereon;
first driving means for driving said mark containing device;
control means for controlling said first driving means; and
wiping means for wiping an excess of ink from said mark containing device;
wherein said printing means comprises:
a print head; and
second driving means for driving said print head between said programmable selecting means and said device;
wherein said second driving means comprises:
a shaft having a first end coupled to said print head and a second end;
a slide defining an opening therein through which said shaft is disposed;
a cam being coupled to said second end of said shaft;
a pin extending from said cam opposite said shaft;
a cam guide block defining an opening in which said pin is slideably disposed; and
a motor coupled to said slide.

2. The programmable pad printer of claim 1 wherein said second driving means further comprises:
disc coupled to said motor; and
a tie bar having a first end coupled to said slide and a second end coupled to said disc.

3. A programmable pad printer comprising:
a first disc having a plurality of marks thereon;
first driving means for rotating said first disc;
control means for controlling said first driving means;
ink means for supplying ink to said first disc;
wiping means for wiping an excess of ink from said first disc;
a device to be marked;
printing means for transferring a designated mark from said first disc to said device, wherein said printing means comprises;
a print head; and
second driving means for driving said print head between said first disc and said device, wherein said second driving means comprises:
a shaft having a first end coupled to said print head and a second end;
a slide defining an opening therein through which said shaft is disposed;
a cam being coupled to said second end of said shaft;
a pin extending from said cam opposite said shaft;
a cam guide block defining an opening in which said pin is slideably disposed; and
a motor coupled to said slide.

4. The programmable pad printer of claim 3 wherein said second driving means further comprises:
a disc coupled to said motor; and
a tie bar having a first end coupled to said slide and a second end coupled to said disc.

* * * * *